US008664872B2

(12) United States Patent
Fukuda et al.

(10) Patent No.: US 8,664,872 B2
(45) Date of Patent: Mar. 4, 2014

(54) CIRCUIT ARRANGEMENT FOR OPERATING A DISCHARGE LAMP

(75) Inventors: Kenichi Fukuda, Burlington, MA (US); Yiyoung Sun, Beverly, MA (US)

(73) Assignee: Panasonic Corporation, Osaka (JP)

( * ) Notice: Subject to any disclaimer, the term of this patent is extended or adjusted under 35 U.S.C. 154(b) by 1046 days.

(21) Appl. No.: 12/710,664

(22) Filed: Feb. 23, 2010

(65) Prior Publication Data

US 2011/0204806 A1 Aug. 25, 2011

(51) Int. Cl.
*H05B 37/00* (2006.01)

(52) U.S. Cl.
USPC ..... 315/224; 315/246; 315/291; 315/294; 315/297

(58) Field of Classification Search
USPC ..... 315/224, 246, 291
See application file for complete search history.

(56) References Cited

U.S. PATENT DOCUMENTS

| | | | | |
|---|---|---|---|---|
| 2002/0190665 | A1* | 12/2002 | Sun | 315/224 |
| 2009/0289581 | A1 | 11/2009 | Matsuzaki et al. | |
| 2009/0315470 | A1 | 12/2009 | Kumagai et al. | |
| 2010/0033692 | A1 | 2/2010 | Watanabe et al. | |
| 2010/0039581 | A1 | 2/2010 | Mishima et al. | |
| 2010/0084988 | A1 | 4/2010 | Nagata et al. | |

* cited by examiner

*Primary Examiner* — Douglas W Owens
*Assistant Examiner* — Jonathan Cooper
(74) *Attorney, Agent, or Firm* — Greenblum & Bernstein, P.L.C.

(57) ABSTRACT

An apparatus for operating a gas discharge lamp. The apparatus includes an electronic ballast and a controller. The electronic ballast includes a half bridge configuration, a full bridge configuration, a first network, and a second network. The electronic ballast is controlled by a controller that causes the half bridge configuration to ignite an arc between electrodes of the gas discharge lamp in an igniter function that uses the first network, to switch the electronic ballast from the half bridge configuration to the full bridge configuration after the arc is ignited so that a buck inverter function using the second network sustains the arc between the electrodes of the gas discharge lamp, and to provide a transient operation function to the buck inverter function to produce a spike voltage that is used to re-ignite the arc between the electrodes of the gas discharge lamp when the arc extinguishes.

20 Claims, 12 Drawing Sheets

$V_{EL}$ with no-load in the conventional buck converter function after disabling the transient operation $V_{EL}$ with no-load in the transient operation on present invention

CIRCUIT ARRANGEMENT FOR OPERATING A DISCHARGE LAMP

BACKGROUND OF THE INVENTION

1. Field of the Invention

The present invention relates to High Intensity Discharge (HID) lamps, and more particularly, to an electronic ballast for use with an HID lamp.

2. Background and Related Information

Generally, there are two types of operation modes for HID lamps. In a first operation mode, generally referred to as a starting mode, a lamp arc tube (e.g., lamp) requires a certain high peak voltage, such as, for example, approximately 3 kV to approximately 5 kV, to ignite an arc between two electrodes in the lamp. In a second operation mode, generally referred to as a lighting mode, the lamp requires a certain RMS current that corresponds to an impedance between the two electrodes in the lamp in order to sustain (maintain) the arc, so that the lamp continues to emit light.

In a conventional electronic ballast, a full bridge circuit may be employed, to which a DC voltage, typically less than 500V, is applied. This conventional electronic ballast has a resonant igniter function for the lamp starting mode and a buck inverter function for the lighting mode.

The resonant igniter function provides the certain high peak voltage output, typically approximately 3 kV to approximately 5 kV peak, which is not constrained by the DC voltage of the full bridge circuit. During the starting mode, a resonance is generated between an internal inductance (inductor) and a capacitance (capacitor) of the electronic ballast. This resonance provides a high peak voltage across the inductor, which is applied to output terminals that are connected to electrodes of an un-ignited HID lamp. However, once the lamp is ignited by the certain high peak voltage, the current provided from the resonant circuit to the lamp load is usually insufficient to sustain the arc inside the lamp arc tube, as only a glow current flows through the lamp.

The buck inverter function (e.g., a circuit that performs DC to AC conversion) provides the necessary certain RMS current to sustain the arc, which is a smoothed DC current chopped at a low frequency (typically limited to a frequency of, for example, less than several hundred Hertz), that is provided to an output load (e.g., the ignited HID lamp). However, a maximum voltage OCV supplied by the circuit (electronic ballast) to the output load is limited by the applied DC voltage to the circuit. The maximum voltage OCV is generally not high enough to re-ignite the arc tube if the arc extinguishes.

Therefore, to operate an HID lamp, a conventional circuit (ballast) typically initially provides the igniter function to ignite the lamp in the starting mode, and then shifts its operation to the buck inverter function to sustain the arc in the lighting mode after it has been detected that the lamp is ignited.

Another operation mode exists between the starting mode and the lighting mode. This operation mode is known as a glow-to-arc transition mode, and occurs when the breakdown between the electrodes of the lamp has just occurred. The glow-to-arc transition mode typically lasts only a few hundred milliseconds to a few seconds. Some HID lamps require both a RMS current and a high peak voltage to heat up the electrodes in order to sustain the arc, or to re-ignite the arc in the event the arc goes out (is extinguished) due to the electrodes not being sufficiently warmed up to sustain the arc.

Unfortunately, the above-described conventional circuit does not provide appropriate output characteristics for the glow-to-arc transition mode. The igniter function of the conventional circuit provides a high peak voltage, but not enough sustaining current, while the buck inverter function provides an adequate RMS current, but not enough high peak voltage.

As a result, there is a shortcoming in the conventional circuit with respect to the igniter function and the buck inverter function. Specifically, the conventional circuit lacks the optimization of lamp glow-to-arc transition required for some HID lamps.

SUMMARY OF THE INVENTION

The present invention solves the above-discussed problem by providing an additional feature to the buck inverter function, referred to as a so-called transient operation function. In the transient operation function, the buck inverter function provides the lamp not only with a sufficient RMS current when the lamp is lit, but also a high enough peak voltage that is greater than the applied DC voltage to the full bridge circuit to re-ignite the arc tube in the event the arc extinguishes, thus preventing a complete extinguishment of the lamp. The transient operation function is a combination of the igniter function and the conventional buck inverter function. The transient operation function is only applied during the first couple of seconds when electrical power is applied to the lamp, and after a breakdown occurs.

The transient operation function combines the transient action of the first network, which is inherent in the first mode (i.e., a low $V_{EL}$, to be discussed below), in the buck inverter function. While the conventional circuit has the transient action with an ignited low voltage lamp, where a clamped spike voltage appears on $V_{EL}$, the present invention realizes the action with a no-load, which exists when the arc goes out (e.g., the lamp is extinguished), by intentionally switching switches of a half bridge configuration to swing the potential of a middle point of a first switch and a second switch between $V_0$ and almost GND. The potential swing causes a charging current (or a discharging current) to flow into a first network, so that the first network generates a spike voltage across a first inductance, which then appears across the electrode terminals of the lamp as a voltage $V_{EL}$. When the arc of the lamp has extinguished, the spike voltage is not clamped. The spike voltage can thus be at least a couple of kVs, which is high enough to re-ignite the arc tube. Since the transient operation is the combination of the buck inverter function and the igniter function, it can immediately provide an adequate RMS current for the lamp to sustain the arc. Thus, the present invention ensures that the lamp is not only provided with an adequate RMS current, but is also provided with a sufficient high peak voltage which is greater than voltage OCV to re-ignite the arc tube in case the arc extinguishes.

Preferably, the transient operation function is provided only for a certain period of time after the arc is ignited between the electrodes, because a normal lamp does not require any high peak voltage to sustain the arc after the electrodes have warmed up. After the transient operation, the full bridge behaves like a conventional buck inverter function. Disabling the transient operation limits the maximum voltage of $V_{EL}$ to $V_0$, avoiding an unwanted situation in which an End-of-Life lamp is inadvertently determined to be a good lamp.

The present invention proposes a circuit arrangement for a HID lamp in which the buck inverter function improves upon the lamp glow-to-arc transition. According to the instant invention, the buck inverter function provides not only an adequate RMS current to the HID lamp, but also a high enough peak voltage that is greater than the maximum voltage OCV, to ensure that the arc between the electrodes of the lamp are re-ignited in the event that the arc extinguishes.

According to an embodiment of the present invention, a full bridge circuit is employed in which a DC input voltage is applied thereto. The full bridge circuit has two fundamental functions and two output networks.

The first function is the resonant igniter function. The resonant igniter function operates as the starting mode of an HID lamp, by generating the resonant voltage using the first network in order to ignite an HID lamp. The second function is the buck inverter function, which operates as the lighting mode to maintain the HID lamp in an illuminating state, by generating an RMS current with the second network that is sufficient to keep the HID lamp lit. In the present invention, the RMS current is a smoothed DC current, but it is chopped and polarity changed every few milliseconds.

The full bridge circuit includes a controller that controls a plurality of switches, such as, for example, four (4) switches by sensing a direct or equivalent current or voltage carried out from or generated by the full bridge circuit. The controller also controls the four (4) switches to turn ON or OFF by counting an elapsed time.

In the disclosed embodiment, each switch comprises a MOSFET transistor. However, it is understood that the switches can be alternative semiconductor elements, such as, but not limited to, for example, bipolar transistors, without departing from the spirit and/or scope of the invention.

By providing a circuit arrangement that includes the resonant igniter function for the lamp starting mode and the buck inverter function for the lamp lighting mode, the present invention enables the buck inverter function to not only supply an adequate RMS current for the lamp lighting mode, but also supply a high enough peak voltage that is greater than the applied DC voltage to the full bridge circuit for the betterment of the lamp glow-to-arc transition. By using both output networks together, the present invention is able to re-ignite the arc of the lamp in the event the arc current extinguishes during the operation of the HID lamp.

According to an object of the present invention, an apparatus for operating a gas discharge lamp, comprises an electronic ballast and a controller. The electronic ballast has a plurality of switches that are arranged in a full bridge configuration. The full bridge configuration includes a first inductance-capacitance network and a second inductance-capacitance network. The first inductance-capacitance network is for an igniter function that is controlled by less than all of the plurality of switches that are arranged in a half bridge configuration. The second inductance-capacitance network is for a buck inverter function that is controlled by all of the plurality of switches. The controller controls the full bridge configuration in the igniter function to ignite an arc between electrodes of a gas discharge lamp. The controller switches an operation of the electronic ballast from the igniter function, after the arc is ignited between the electrodes of the gas discharge lamp, to the buck inverter function to sustain the arc between the electrodes of the gas discharge lamp. The controller additionally controls the full bridge configuration to operate the buck inverter function in such a way that at least when the arc between the electrodes extinguishes, a swing voltage is generated across a first inductance of the first inductance-capacitance network to re-ignite the arc between the electrodes of the gas discharge lamp.

According to a feature of the invention, the controller controls the less than all of the plurality of switches (which may be, but is not limited to, for example, MOSFET transistors) in the half bridge configuration to generate the swing voltage across the first inductance at least when the arc between the electrodes is extinguished. The swing voltage is generated by controlling the less than all of the plurality of switches in the half bridge configuration to alternately turn ON and OFF to change a potential of a connection point where the first inductance-capacitance network is connected between an applied DC voltage and GND.

According to a feature of the present invention, when one switch of the less than all of the plurality of switches is controlled by the controller to turn ON, another switch of the less than all of the plurality of switches is controlled by the controller to turn OFF. The another switch may be controlled to turn back ON in a soft switching mode. Additionally, the controller may control the less than all of the plurality of switches in the half bridge configuration to alternately turn ON and OFF in a soft switching mode.

According to another feature of the present invention, the operation of the less than all of the plurality of switches in the half bridge configuration is controlled by the controller to generate a swing voltage across the first inductance even if the arc between the electrodes is sustained. Further, the swing voltage may be generated when a certain time elapses. In addition, the generation of the swing voltage may be inhibited when the arc extinguishes during the operation of the buck inverter function if a certain time has elapsed after the arc breaks down.

According to a still further feature of the present invention, the buck inverter function delivers power to the discharge lamp changing a polarity at a frequency lower than a switching frequency of the buck inverter.

According to another object of the present invention, an apparatus is disclosed for operating a gas discharge lamp. The apparatus includes an electronic ballast and a controller. The electronic ballast includes a first inductance-capacitance network that is formed of a first inductance and a first capacitance, a second inductance-capacitance network that is formed of a second inductance and a second capacitance, a first half bridge configuration that utilizes the first inductance-capacitance network in an igniter function, and a second half bridge configuration that is utilized with the first half bridge configuration as a full bridge configuration, in which the full bridge configuration utilizes the second inductance-capacitance network in a buck inverter function. The controller controls the first half bridge configuration to ignite an arc between electrodes of a gas discharge lamp using the igniter function. The controller also controls the electronic ballast to change from the first half bridge configuration to the full bridge configuration after the arc is ignited, so that the buck inverter function of the full bridge configuration sustains the arc between the electrodes of the gas discharge lamp. In addition, the controller engages a transient operation function to produce a swing voltage across the first inductance to effect re-ignition of the arc between the electrodes of the gas discharge lamp at least when the arc extinguishes. It is noted that the swing voltage is generated by the first half bridge configuration.

The first half bridge configuration may include a first switch and a second switch. The full bridge configuration may include the first switch, the second switch, a third switch and a fourth switch. When the controller controls the electronic ballast to operate in the igniter function, the first switch and the second switch are alternately turned ON and OFF, while the third switch and the fourth switch may be turned ON.

According to an additional object of the present invention, an apparatus for operating a gas discharge lamp is disclosed that includes an electronic ballast that has a half bridge configuration that is formed by a first switch and a second switch, a full bridge configuration that is formed by the first switch and the second switch, a third switch and a fourth switch, a first network that is formed by a first inductance and a first capacitance, and a second network that is formed by a second inductance and a second capacitance. The apparatus further includes a controller that controls the half bridge configuration to ignite an arc between electrodes of the gas discharge lamp in an igniter function that uses the first network, to switch from the half bridge configuration to the full bridge configuration after the arc is ignited, so that a buck inverter function using the second network sustains the arc between the electrodes of the gas discharge lamp, and to additionally provide a transient operation function to the buck inverter function to produce a spike voltage to re-ignite the arc between the electrodes of the gas discharge lamp when the arc extinguishes. It is noted that each switch may comprise a MOSFET transistor or similar type semiconductor device.

According to a feature of the present invention, the spike voltage is greater than a DC voltage that is applied to the full bridge configuration.

According to another feature of the present invention, the transient operation function comprises a combination of the igniter function and the buck inverter function. The transient operation function causes a current to flow into first network to generate spike voltage across the first inductance, which then appears across the electrodes of the gas discharge lamp. The voltage level of the spike voltage is sufficient to re-ignite the arc between the electrodes of the gas discharge lamp. The transient operation function may be applied only during a predetermined time period after electrical power is applied to the gas discharge lamp and when a breakdown occurs.

BRIEF DESCRIPTION OF THE DRAWINGS

These and other objects, advantages and features of the present invention will become apparent from the following description thereof taken in conjunction with the accompanying drawings that illustrate specific embodiments of the present invention, in which.

DETAILED DESCRIPTION OFA PREFERRED EMBODIMENT

Figure 11:
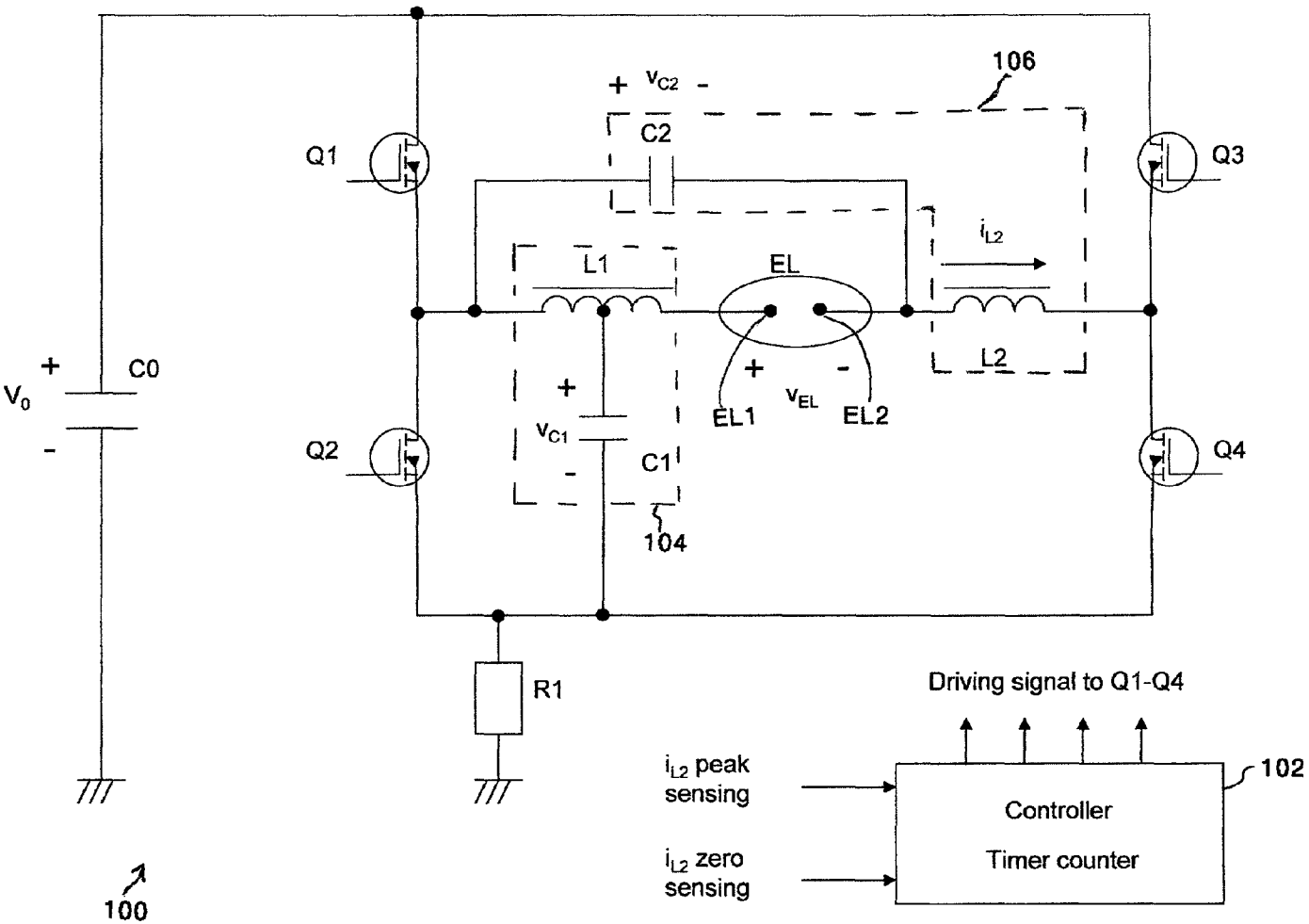
FIG. 11 illustrates an example of a conventional circuit arrangement.

A simplified diagram of a conventional circuit arrangement 100 for driving a HID lamp EL is illustrated in FIG. 11. In the first function (i.e., igniter function), switches Q1 and Q2 are alternately turned ON and OFF by a controller 102 at a predetermined frequency, in order to generate a resonance in a first network 104 formed by a first inductance L1 and a first capacitance C1. The resonant action of the first inductance L1 and first capacitance C1 generates a high resonant voltage across the first inductance L1. The high resonant voltage is transferred to arc tube electrodes EL1 and EL2 of the HID lamp EL to ignite the HID lamp EL.

When the ignition of the HID lamp EL is detected by the controller 102, the circuit 100 switches to the second function (i.e., buck inverter function). The second function consists of two phases. The first phase is when switches Q1 and Q4 are actively controlled to regulate power across the HID lamp EL using a second network 106 formed by second inductance L2 and second capacitance C2, while the second phase is when switches Q2 and Q3 are actively controlled.

There are two operation modes in the second function, which are classified by a lamp voltage $V_{EL}$. The first mode is when a voltage $V_{EL}$ in the HID lamp EL is at a relatively low level. The second mode is when the voltage $V_{EL}$ is relatively normal or high.

Figure 2:
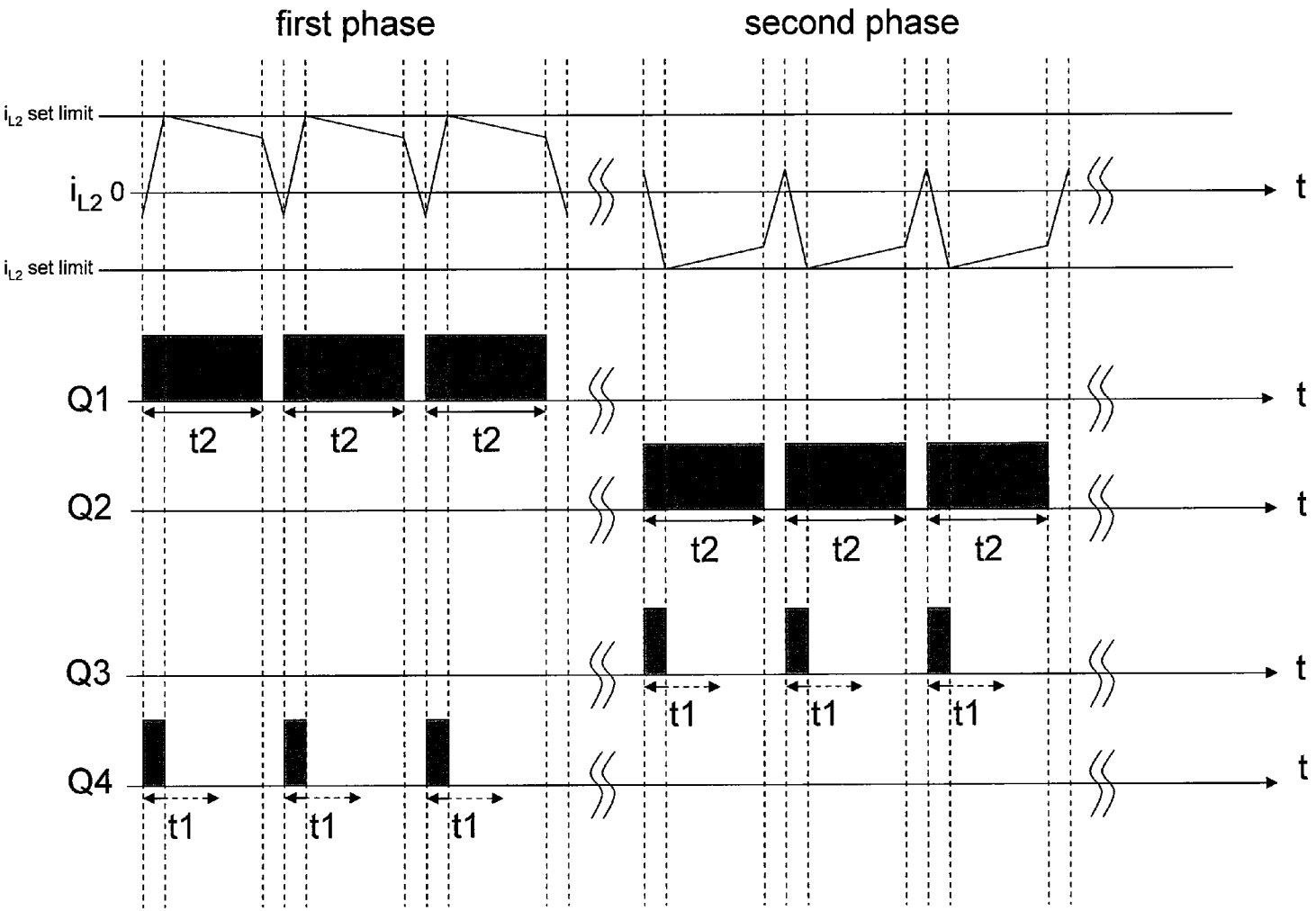
FIG. 2 illustrates a switching diagram of an electronic ballast operating in a first mode (low $V_{EL}$) of a buck inverter function.

FIG. 2 shows a relationship between a current $i_{L2}$ in the second inductance L2 and an operation of switches Q1-Q4 during the first mode, when the voltage $V_{EL}$ in the HID lamp EL is relatively low. A timer counter in the controller 102 starts counting when switches Q4 and Q1 are turned ON in the first phase, or switches Q3 and Q2 are turned ON in the second phase. The current $i_{L2}$ starts to rise until it reaches a set limit $i_{L2\ set\ limit}$ or the timer counter reaches a set time t1.

In the first phase, when switches Q4 and Q1 are turned ON, the current $i_{L2}$ ramps up positively (see direction of arrow in FIG. 11), and second capacitance C2 is positively charged, via switch Q4, resistance R1, capacitance C0 and switch Q1. When the current $i_{L2}$ reaches the set limit $i_{L2\ set\ limit}$ (or the timer counter reaches a set time t1), switch Q4 is turned OFF and the current $i_{L2}$ starts to decay. It is noted that in FIG. 2, switch Q4 is illustrated as always being turned OFF, due to the current $i_{L2}$ reaching the set limit $i_{L2\ set\ limit}$, and not due to the timer counter reaching the set time t1. Since switch Q1 is ON, the current $i_{L2}$ positively charges the second capacitance C2 through a body diode (not labeled) of switch Q3, instead of a channel (not labeled) of switch Q4. Then, switch Q1 is turned OFF when the timer counter reaches another set time t2 and the current $i_{L2}$ even more rapidly decays toward zero. When switch Q1 is turned OFF, the current $i_{L2}$ goes through the body diode of Q3, the capacitance C0, the resistance R1, a body diode (not labeled) of Q2 and the second capacitance C2, until it reaches zero. When the controller 102 senses that the current $i_{L2}$ has reached or passed over a certain level, which is typically zero, a timer counter in the controller 102 is reset and switches Q4 and Q1 are turned back ON.

When switches Q3 and Q2 are turned ON in the second phase, current $i_{L2}$ ramps down (e.g., goes negative) and the second capacitance C2 is charged in the opposite direction through switch Q2, resistance R1, capacitance C0 and switch Q3. When current $i_{L2}$ reaches the set limit $i_{L2\ set\ limit}$ (or the timer counter reaches set time t1), switch Q3 is turned OFF and current $i_{L2}$ starts to decay. In this regard, as noted above, switch Q3 is always turned OFF in FIG. 2 due to the current $i_{L2}$ reaching the set limit $i_{L2\ set\ limit}$, and not due to the timer counter reaching the set time t1. Since switch Q2 is ON, current $i_{L2}$ is being charged in the opposite direction through the second capacitance C2 via the body diode of switch Q4 instead of the channel of switch Q3. Switch Q2 is turned OFF when the timer counter reaches another set time t2 and the current $i_{L2}$ more rapidly decays toward zero. When switch Q2 is turned OFF, current $i_{L2}$ passes through the body diode of switch Q1, capacitance C0, resistance R1, body diode of switch Q4 and second capacitance C2, until the current $i_{L2}$ reaches zero. When the controller 102 senses that current $i_{L2}$ has reached or passed over a certain level (which is typically zero), the timer counter in the controller 102 is reset and re-starts (repeats the above discussed operations). Switches Q3 and Q2 are then turned back ON.

When switches Q1 and Q2 are turned OFF due to the timer counter reaching set time t2, a potential at a connection point of switches Q1 and Q2 is suddenly changed from being substantially equal to a voltage $V_0$ to being equal to almost GND, or from being equal to almost GND to being substantially equal to the voltage $V_0$. This potential change causes a discharging (or charging) current to flow through the first network and generate a spike voltage across the first inductance L1, because current goes through the first capacitance C1 and primary of the first inductance L1. However, since the voltage $V_{EL}$ across the arc tube electrodes EL1 and EL2 of the HID lamp EL is low, an impedance across the arc tube electrodes EL1 and EL2 is also low. Thus, a spike voltage that appears across the arc tube electrodes EL1 and EL2 is not very high.

Figure 3:
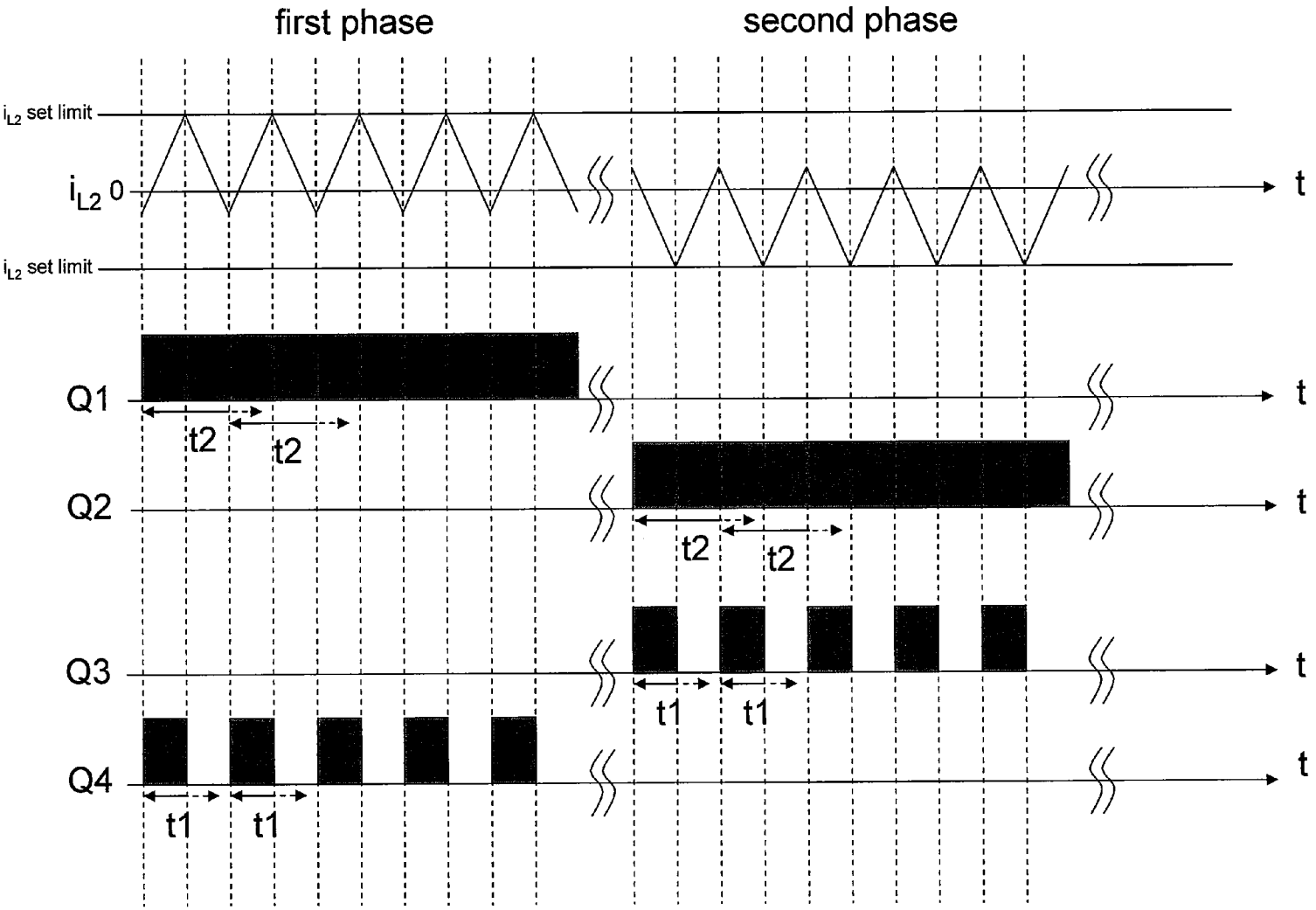
FIG. 3 illustrates a switching diagram of the circuit arrangement in a second mode (high $V_{EL}$) of the buck inverter function.

FIG. 3 shows the relationship between the current $i_{L2}$ and the operation of switches Q1-Q4 during the second mode (i.e., when the voltage $V_{EL}$ is normal or high). The timer counter in the controller 102 starts counting when switches Q4 and Q1 are turned ON in the first phase (or switches Q3 and Q2 are turned ON in the second phase), and the current $i_{L2}$ rises (increases) until it reaches a set limit or the timer counter in the controller 102 reaches a set time.

When switches Q4 and Q1 are turned ON, current $i_{L2}$ ramps up (increases), positively charging the second capacitance C2 through switch Q4, resistance R1, capacitance C0 and switch Q1. When switches Q3 and Q2 are turned ON, current $i_{L2}$ ramps down (decreases), negatively charging the second capacitance C2 through switch Q2, resistance R1, capacitance C0 and switch Q3. Switch Q4 or switch Q3 turns OFF when the current $i_{L2}$ reaches the set limit or the timer counter reaches set time t1, and current $i_{L2}$ starts to decay. It is noted that in FIG. 3, switch Q4 or switch Q3 is always turned OFF due to the current $i_{L2}$ reaching the set limit, and not due to the timer counter reaching the set time t1. Switch Q4 or switch Q3 turns back ON when the current $i_{L2}$ has reached (or passed over) a certain level, which is typically zero, and the timer counter is reset and re-starts. Because the timer counter never reaches another set time t2, switch Q1 or switch Q2 is mostly being turned ON.

The arc between the electrodes EL1 and EL2 is not stable during the lamp's glow-to-arc transition because the electrodes EL1 and EL2 are not sufficiently warmed up. Adequately heating up the electrodes of the HID lamp EL, which is equivalent to making the arc stable, requires that a certain amount of smoothed DC current flow between the electrodes EL1 and EL2. Preferably, the smoothed DC current that is applied to the electrodes EL1 and EL2 has a low frequency changing polarity. That is the reason why a conventional circuit changes its operation from the igniter function to the buck inverter function after it detects the lamp is ignited.

However, even if the conventional circuit is operating in the buck inverter function, the HID lamp may still extinguish. This is especially a problem at the moment of phase transition. At a low frequency, the arc tends to extinguish because the lamp current has to be zero for a brief period of time. When the arc extinguishes, a high voltage with a sharp voltage slope is required to re-ignite the lamp. When the arc extinguishes at any time, either during a phase transition or not during a phase transition, a no-load situation is created. The buck inverter function charges the second capacitance C2, such that an absolute voltage $|V_{C2}|$ of the second capacitance C2 gradually increases towards $|V_0|$.

Figure 4:
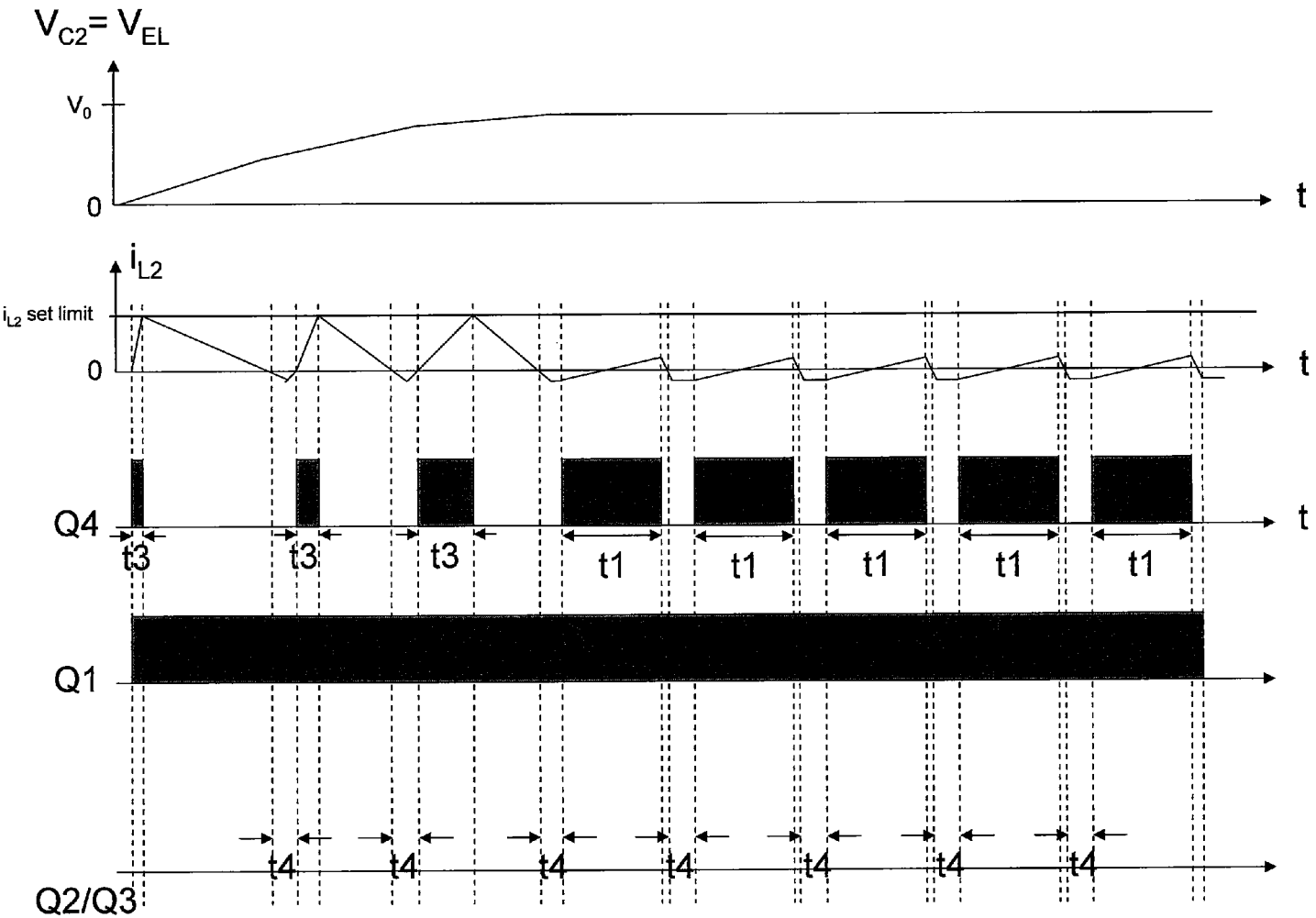
FIG. 4 illustrates a $V_{EL}$ transition of the buck inverter function with no-load during a first phase.

At no-load, the absolute voltage $|V_{C2}|$ is the same as an absolute voltage $|V_{EL}|$ across the HID lamp EL. FIG. 4 illustrates when the arc extinguishes during the first phase where switch Q4 and switch Q1 are actively being controlled. "t3" represents a variable time from when switch Q4 transitions from ON to OFF. "t1" represents a fixed time, as mentioned above, from when switch Q4 transitions from ON to OFF in the case that the current $i_{L2}$ does not reach a set limit. As shown in FIG. 4, "t3" is less than "t1". "t4" is also a fixed time delay between the current $i_{L2}$ passing over the zero level when switch Q4 transitions from OFF to back to ON. As shown in FIG. 4, voltage $V_{C2}$ across the second capacitance C2 is equal to voltage $V_{EL}$ across the lamp EL, and is gradually charged up to voltage $V_0$, which is an applied DC voltage of the circuit 100. If the voltage $V_{C2}$ cannot re-ignite the arc tube, the conventional circuit switches from the buck inverter function to the igniter function to attempt to generate a high voltage. In the igniter function, the circuit generates a high peak resonant voltage to attempt to re-ignite the arc tube. However, as mentioned above, the conventional circuit 100 does not provide an appropriate RMS current to the lamp during the igniter function unless it switches (changes) the operation of the circuit (electronic ballast) 100 from the igniter function to the buck inverter function. With these incompatible requirements from an HID lamp, the conventional circuit 100 does not provide adequate re-starting performance.

Figure 1:
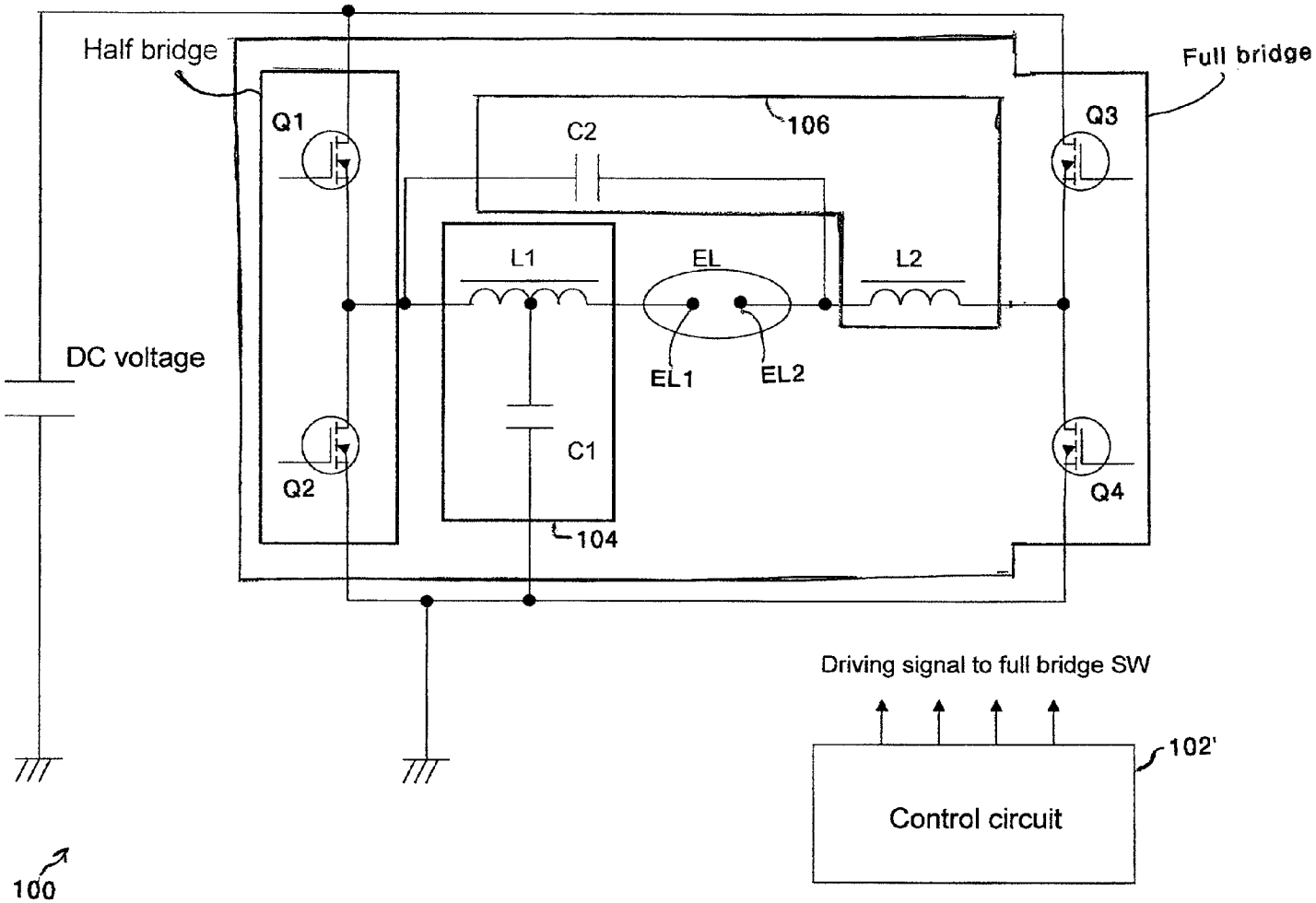
FIG. 1 illustrates a simplified schematic diagram for a circuit arrangement (electronic ballast) for a HID lamp according to the present invention.

The following is an explanation of a preferred embodiment of the present invention, in which the circuit arrangement is in the transient operation mode. It is noted that elements in the conventional circuit of FIG. 11 that correspond to like elements in FIG. 1 have the same element numbers. The circuit diagram shown in FIG. 11 is comparable to the preferred embodiment of FIG. 1, but for the controller (labeled as element 102 in FIG. 11 and labeled as element 102' in FIG. 1).

Figure 5A:
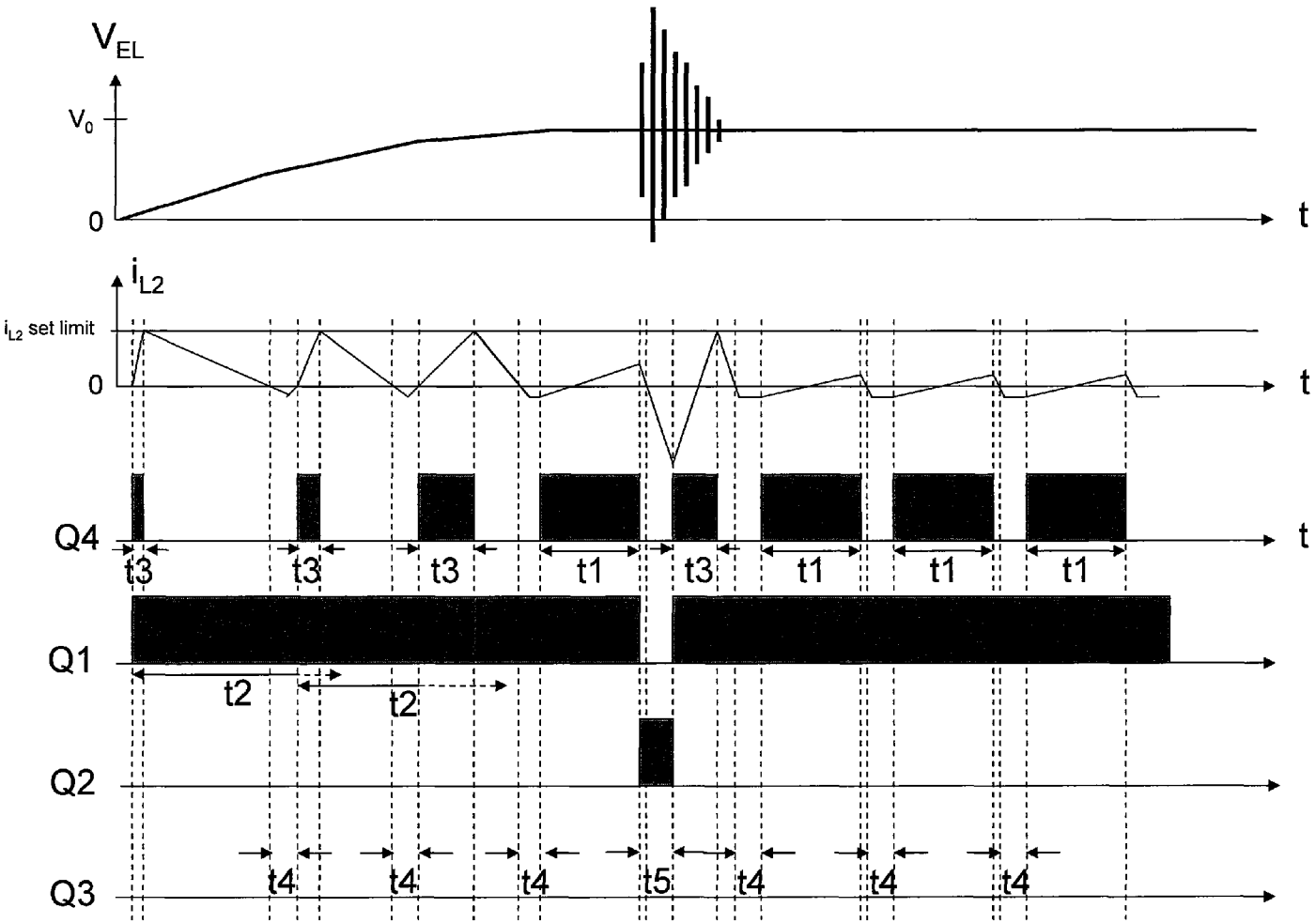
FIG. 5A illustrates a $V_{EL}$ transition of the present invention in a transient operation function with no-load during a first phase.

FIG. 5A illustrates an example of the relationship between the operation of switches Q1-Q4 and current $i_{L2}$ in the first phase with no-load on the circuit (electronic ballast) 100. When the voltage $V_{C2}$ rises, which is equivalent to the situation after the arc between the electrodes EL1 and EL2 extinguishes, switches Q1 and Q2 are operated when switch Q4 is preferably OFF.

During the first phase, just before switches Q1 and Q2 are switched to generate the spike voltage across the first network, the voltage potential of the middle point of switches Q1 and Q2 is ideally approximately equal to $V_0$ because switch Q1 is ON, and the first capacitance C1 is charged to approximately $V_0$. When switch Q1 turns OFF and switch Q2 turns ON, the potential of the middle point of switches Q1 and Q2 is suddenly pulled down to a potential level substantially equal to GND. At that moment, the potential of a connection point between the first inductance L1 and the first capacitance C1 starts swinging down toward negative, and swings back to positive at a frequency which is ideally equal to a resonant frequency of the primary inductance of the first inductance L1 and first capacitance C1 (ignoring the effect of any parasitic capacitance that may exist).

On the other hand, $V_{C2}$ starts discharging as current $i_{L2}$ goes down toward negative, through switch Q2 and the body diode of switch Q4. After a selected delay "t5", switch Q2 turns OFF and switches Q1 and Q4 turn ON. Preferably, the selected delay "t5" is set to turn switch Q2 OFF and switch Q1 ON not only during the voltage potential of the connection point of the first inductance L1 and first capacitance C1 swing down to negative, but also when current $i_{L2}$ flows negative. When switch Q1 is ON and switch Q2 is OFF, the potential of the middle point of switches Q1 and Q2 is $V_0$ against the negative voltage potential of the connection point of the primary of the first inductance L1 and first capacitance C1. It is noted that the voltage across the first capacitance C1 can exceed potential "$V_0$". FIG. 5A shows that swing voltage $V_{C1}$ across the first capacitance C1 is multiplied by the first inductance L1 and is superimposed on $V_{EL}$.

Figure 5B:
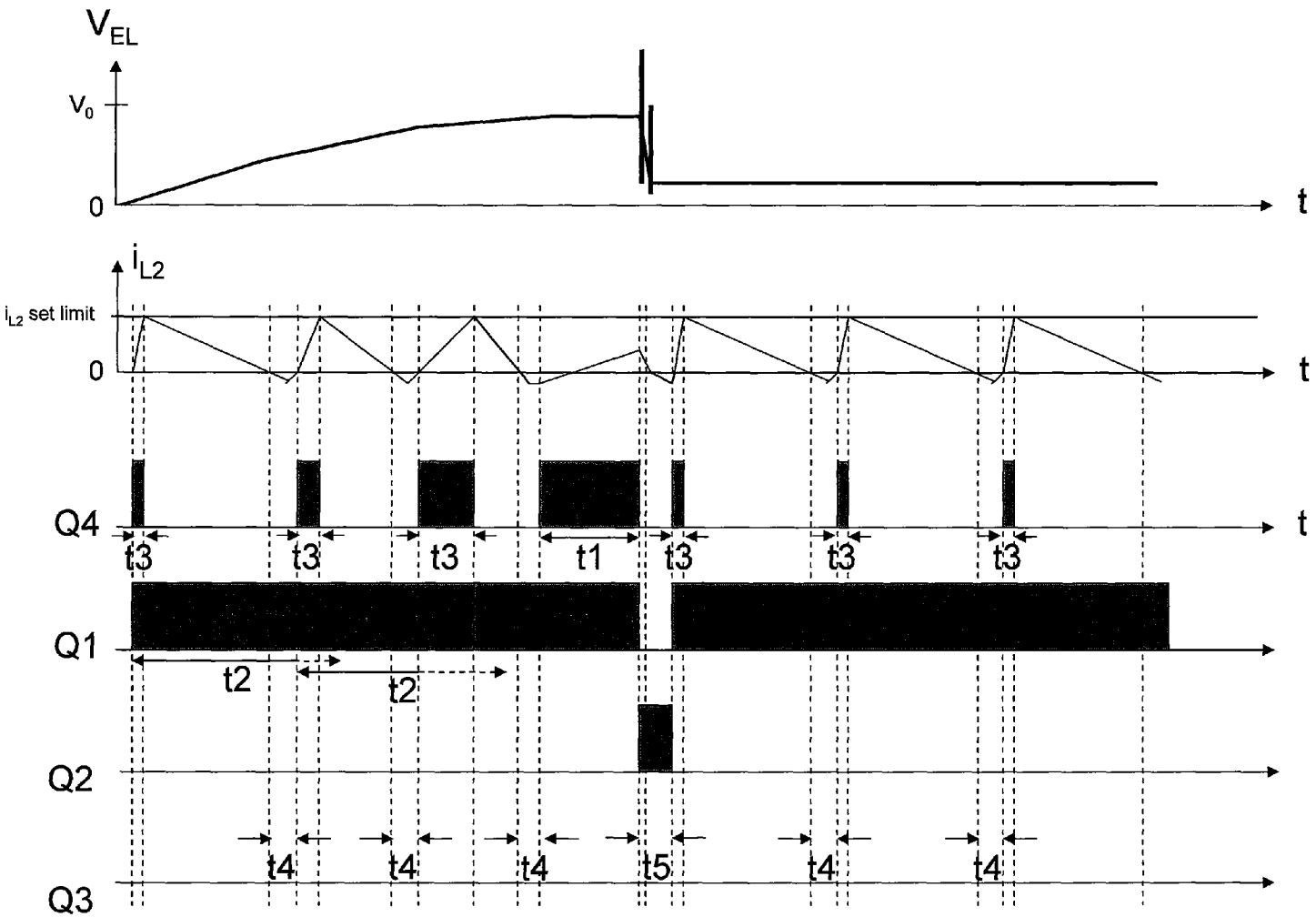
FIG. 5B illustrates the $V_{EL}$ transition of the present invention in the transient operation function in the first phase, when an arc of a lamp extinguishes and is re-established.

FIG. 5B shows an example of the relationship between the operation of switches Q1-Q4 and current $i_{L2}$ in the first phase with an arc extinguished lamp. When voltage $V_{C2}$ (which is equivalent to voltage $V_{EL}$) is rising, switches Q1 and Q2 are switched when switch Q4 is OFF. A swing voltage appears on $V_{EL}$ without appearing on voltage $V_{C2}$. The swing voltage on $V_{EL}$ results in an immediate re-ignition of the arc of the arc-extinguished lamp, $V_{C2}$ starts to rapidly discharge, and $V_{EL}$ ramps down. After a selected delay "t5" elapses, switch Q2 turns OFF and switches Q1 and Q4 turn ON. The transient operation mode then regulates power to the lamp EL to sustain the arc in the same manner that a conventional buck converter does.

Figure 6:
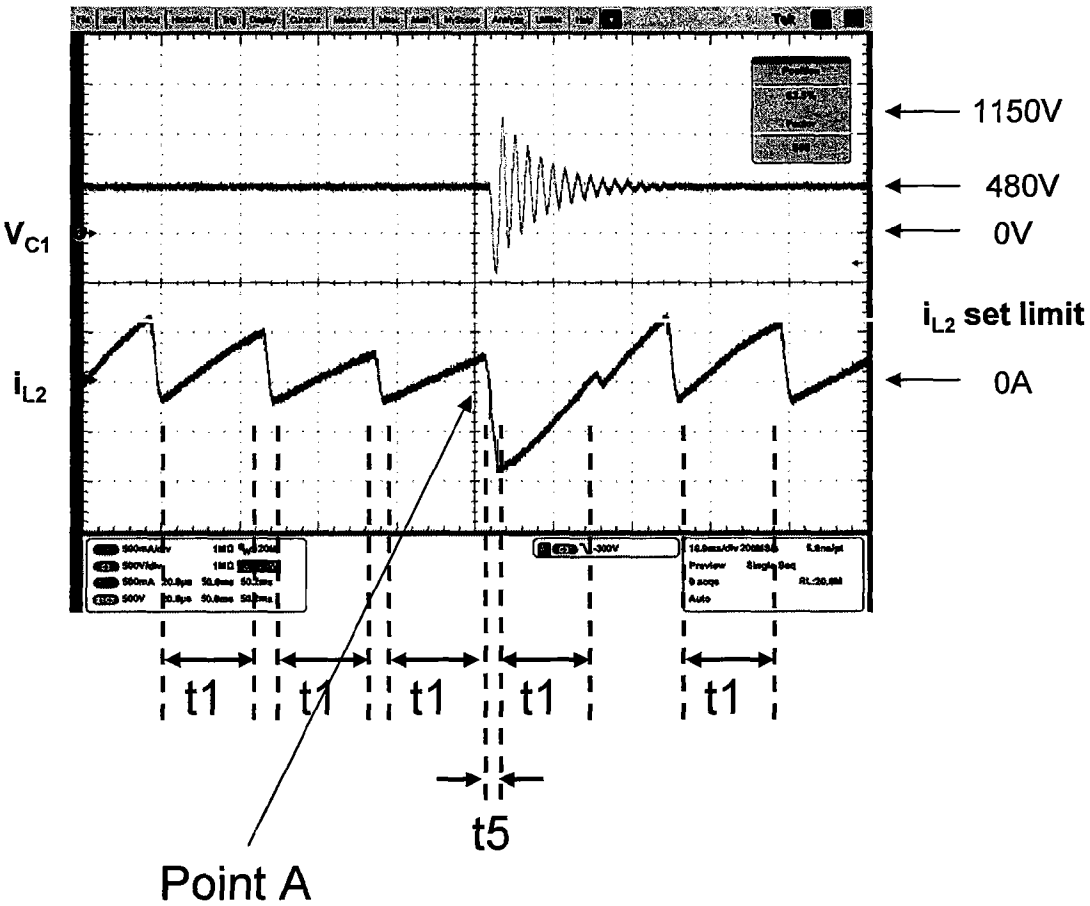
FIG. 6 illustrates $V_{C1}$ and $i_{L2}$ transition of the present invention in the transient operation function with no-load during the first phase.

FIG. 6 illustrates a screen shot of the transient action of the connection point of the first inductance L1 and the first capacitance C1, looking at swing voltage $V_{C1}$ and current $i_{L2}$ during the first phase in the transient operation of an embodiment circuit with no-load. $V_0$ was set to 480V. $V_{C1}$ was charged up to $V_0$. At point A, switch Q4 turns OFF. Then, switch Q1 is OFF and switch Q2 is ON. After the expiration of delay "t5", switch Q2 is turned OFF and switch Q1 in turned ON again, while switch Q4 is also ON.

Figure 7:
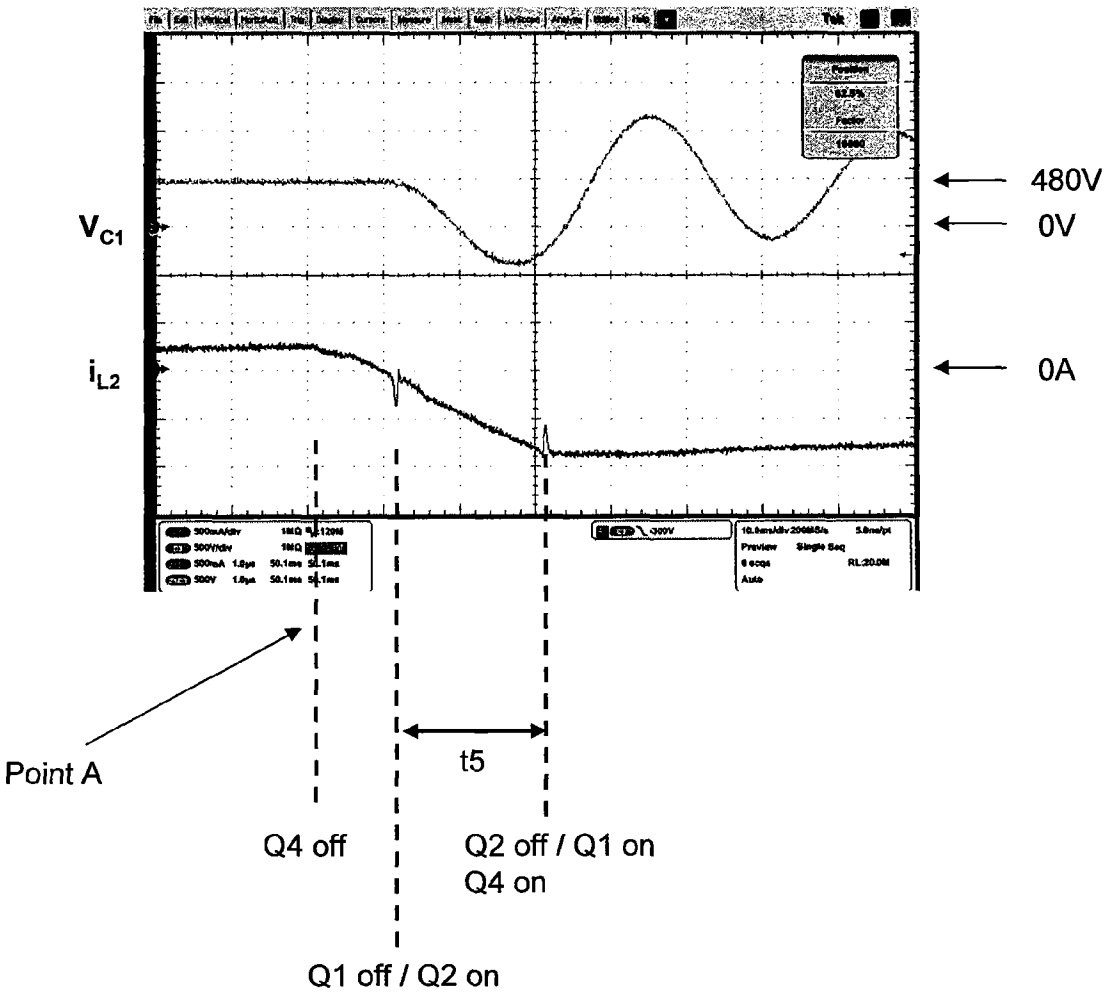
FIG. 7 represents an enlarged picture of a portion of FIG. 6.

FIG. 7 represents a screen shot zoom-in picture of FIG. 6. As shown in FIG. 7, delay "t5" is set to alternate switches Q1 and Q2 not only as the potential of the connection point of the first inductance L1 and the first capacitance C1 swings down to negative, but also during the time that current $i_{L2}$ flows negative, when current $i_{L2}$ flows through second capacitance C2, switch Q2 and the body diode of switch Q4, so that any hard switching current will not appear when switches Q1 and Q4 turn back ON. As shown in FIG. 6 (or the enlarged view of FIG. 7), a peak voltage of voltage $V_{C1}$ can be more than 1,000V with a no-load if delay "t5" was selected correctly. Voltage $V_{C1}$ is multiplied by the first inductance L1 when it appears on voltage $V_{EL}$. Thus, the voltage is high enough to re-ignite the arc of an arc-extinguished lamp.

Figure 8B:
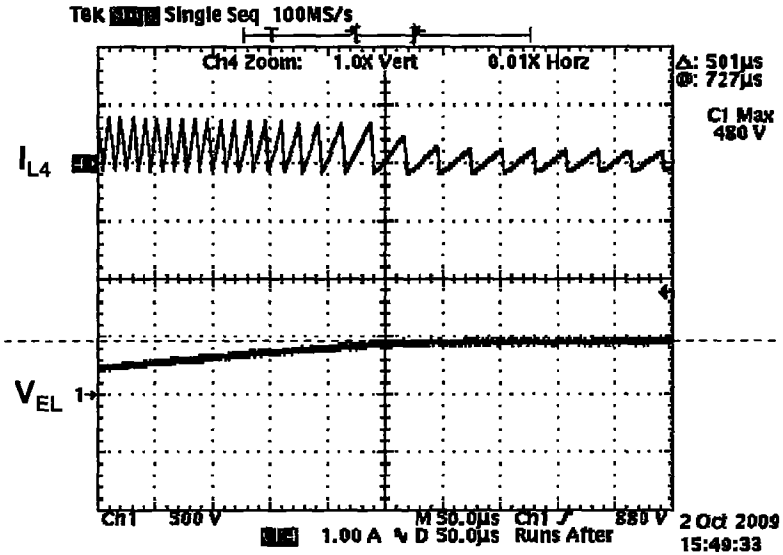
FIG. 8 illustrates, in the first phase, a $V_{EL}$ transition of a preferable embodiment of the present invention with no-load, comparing it to when it is in the transient operation (FIG. 8A) and it is in the conventional buck inverter function after disabling the transient operation function (FIG. 8B)
Figure 8A:
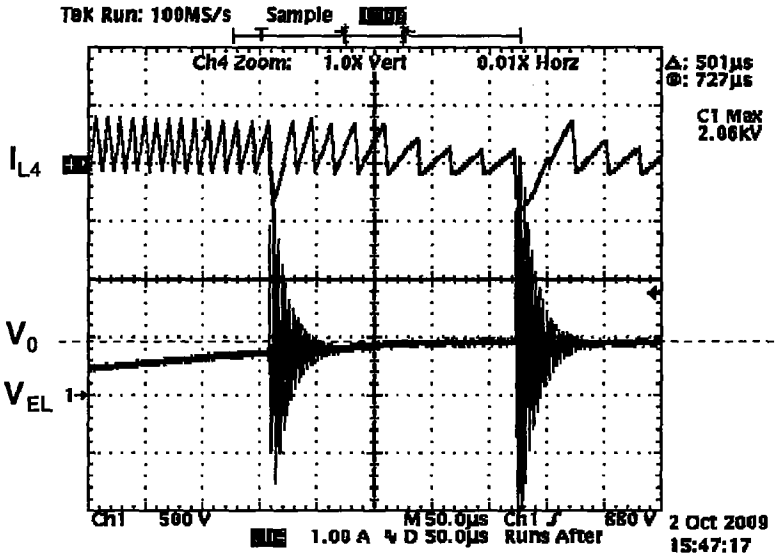

As shown in FIG. 8A, the voltage $V_{EL}$ during a transient operation function in the first phase of the embodiment of the present invention with no-load can have a peak swinging voltage on voltage $V_{EL}$ in excess of 2 kV. On the other hand, FIG. 8B depicts that the maximum voltage across $V_{EL}$ is limited to voltage $V_0$ (which is approximately 480V in the discussed embodiment) when the transient operation function of the present invention is disabled, such that the circuit reverts to a conventional buck inverter function. In a preferred embodiment, the transient operation function is disabled after the passage of a certain time from igniting the arc, and is changed to a conventional buck inverter function, so that voltage $V_{EL}$ is limited to approximately 480V. In this regard, it is noted that a normal HID lamp requires both a certain RMS current to sustain the arc between the electrodes of the lamp and a high peak voltage to re-establish the arc when it is extinguished, with the peak voltage being needed for only a couple of seconds after the initial power is applied to the lamp. After the electrodes are adequately warmed up, the maximum voltage of $V_0$ (approximately 480V in the disclosed embodiment) is sufficient to maintain the arc.

Maintaining the transient operation function for an extended time period may result in treating a bad lamp, such as, for example, an end-of-life lamp, as being a light-able good lamp. Therefore, the disclosed embodiment intentionally provides for the operation of the transient operation function only for a couple of seconds from igniting an arc after electrical power is applied to the lamp. Thereafter, the controller 102' changes the operation of the electronic ballast 100 from the transient operation function to the conventional buck inverter function, so that the present invention will not result in any potentially undesired situation of the lamp being determined to be a good lamp (and thus, forcing a bad lamp to light, which is not desirable).

Figure 9:
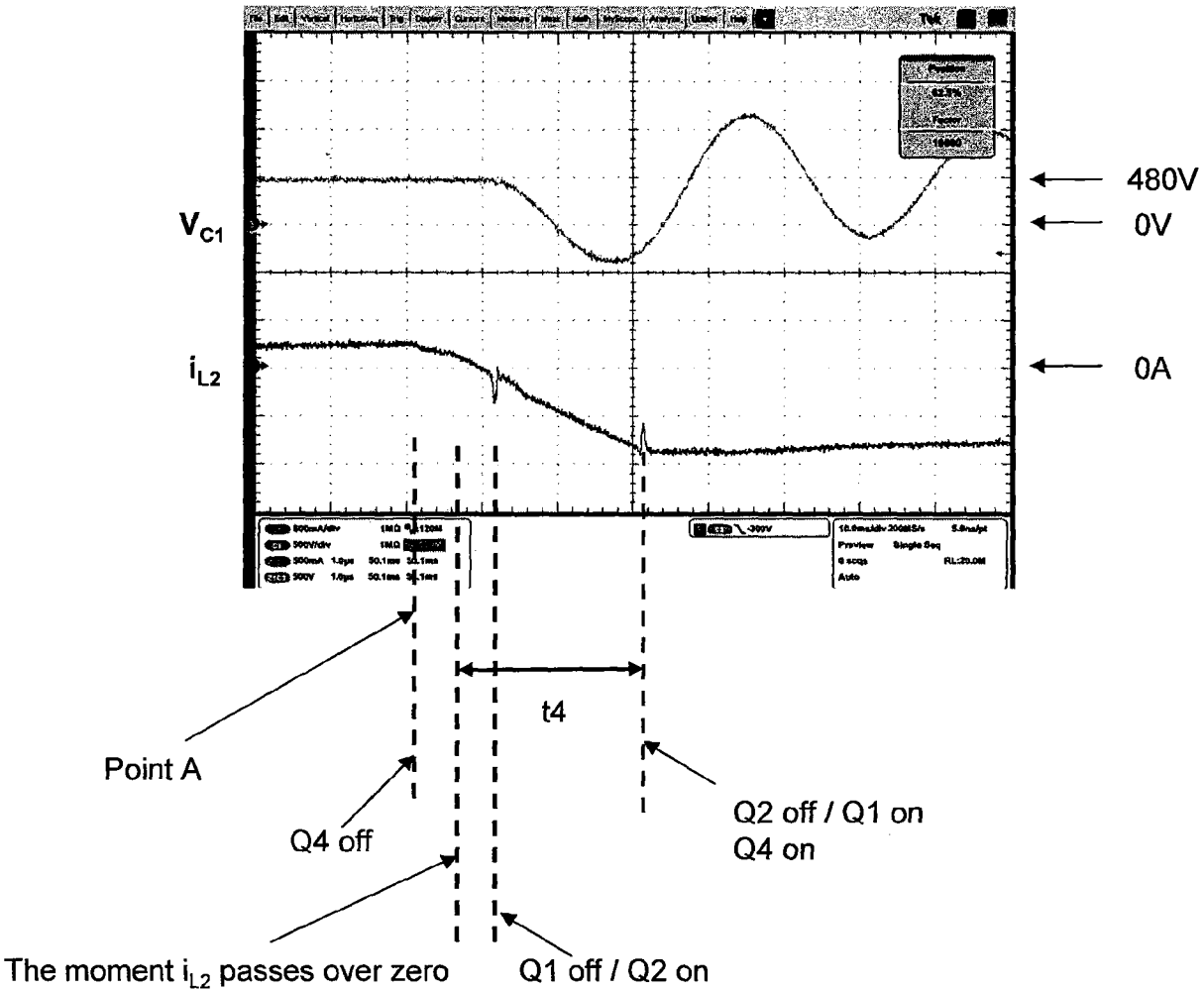
FIG. 9 illustrates an alternative way of setting a timing of switches Q1 and Q2 back.

FIG. 9 illustrates that delay "t5" can be replaced by delay setting "t4", which is a delay that occurs between current $i_{L2}$ reaching (or passing) over zero and switch Q4 being turned back ON. After turning switch Q4 OFF, the current $i_{L2}$ that passes over zero is sensed, and then, switch Q1 is turned OFF and switch Q2 is turned ON. After the expiration of the delay setting "t4", switches Q4 and Q1 are turned back ON and switch Q2 is turned OFF. If the delay setting "t4" is set to change the state of switches Q1 and Q2 when a potential of the connection point between the first inductance L1 and the first capacitance C1 swings down to negative, delay "t5" is not needed to be set separately.

According to the present invention, a much higher peak voltage can be generated across the first inductance L1, which also appears on voltage $V_{EL}$ in the transient operation function, as compared with the conventional circuit. When the HID lamp EL is connected to the circuit (electronic ballast) of the present invention and the arc extinguishes during the lamp's glow-to-arc transition, the peak voltage $V_{EL}$ (which has a sharp slope) re-ignites the arc with certainty. When the arc is re-ignited, the absolute value of the voltage $|V_{C2}|$ across the second capacitance C2 is discharged through the HID lamp EL, which warms up (heats) the electrodes. The transient operation function is embedded in the buck inverter function under the control of the controller 102'. The immediate re-ignition of an extinguished provides a smoothed DC current to the electrodes of the HID lamp EL and results in the adequate warming up of the electrodes.

Figure 10:
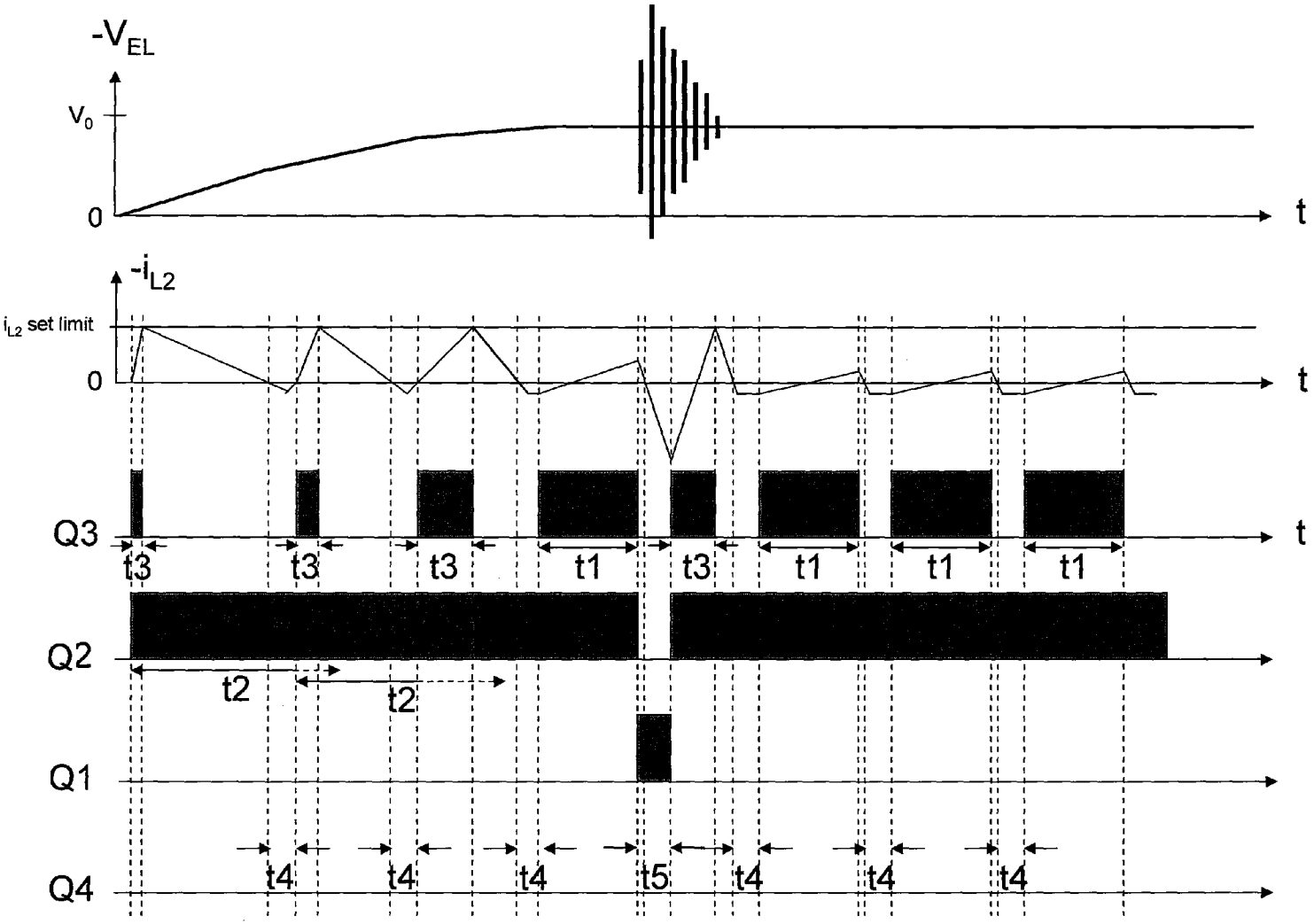
FIG. 10 illustrates, in a second phase, $V_{EL}$ transition of the present invention in the transient operation with no-load.

As shown in FIG. 10, the transient operation function of the present invention can also generate a high peak voltage during the second phase, in a manner similar to that described above. Thus, the present invention also offers much better starting performance than a conventional circuit.

The foregoing discussion has been provided merely for the purpose of explanation and is in no way to be construed as limiting the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and/or spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

The methods described herein comprise dedicated hardware implementations including, but not limited to, application specific integrated circuits (ASIC), programmable logic arrays (PLA), digital signal processor (DSP) and other hardware devices constructed to implement the methods described herein. However, it is understood that the invention may be implemented in software that is executed by a processor, computer or dedicated integrated circuit (such as, for example, a PLA, DSP or PLA). Furthermore, alternative software implementations including, but not limited to, distributed processing or component/object distributed processing, parallel processing, or virtual machine processing can also be constructed to implement the methods described herein. In addition, although the present specification may describe components and functions implemented in the embodiments with reference to particular standards and protocols, the invention is not limited to such standards and protocols. Such standards are periodically superseded by faster or more efficient equivalents having essentially the same functions. Replacement standards and protocols having the same functions are considered equivalents.

We claim:

1. An apparatus for operating a gas discharge lamp, comprising:

an electronic ballast having a plurality of switches arranged in a full bridge configuration, said full bridge configuration including a first inductance-capacitance network and a second inductance-capacitance network, said first inductance-capacitance network being for an igniter function controlled by less than all of said plurality of switches that are arranged in a half bridge configuration, said second inductance-capacitance network being for a buck inverter function controlled by all of said plurality of switches; and a controller, said controller controlling said full bridge configuration in said igniter function to ignite an arc between electrodes of a gas discharge lamp, said controller switching an operation of said electronic ballast from said igniter function after the arc is ignited between the electrodes of the gas discharge lamp to said buck inverter function to sustain the arc between the electrodes of the gas discharge lamp, wherein said controller controls said full bridge configuration to operate said buck inverter function in such a way that at least when the arc between the electrodes extinguishes, a swing voltage having a decreasing amplitude above and below a lamp voltage is generated across a first inductance of said first inductance-capacitance network over a plurality of periods to re-ignite the arc between the electrodes of the gas discharge lamp.

2. The apparatus of claim 1, wherein said controller controls said less than all of said plurality of switches in said half bridge configuration to generate said swing voltage across said first inductance at least when the arc between the electrodes is extinguished.

3. The apparatus of claim 1, wherein said swing voltage is generated by controlling said less than all of said plurality of switches in said half bridge configuration to alternately turn ON and OFF to change a potential of a connection point where said first inductance-capacitance network is connected between an applied DC voltage and GND.

4. The apparatus of claim 2, wherein when one switch of said less than all of said plurality of switches is controlled by said controller to turn ON, another switch of said less than all of said plurality of switches is controlled by said controller to turn OFF.

5. The apparatus of claim 4, wherein said another switch is controlled to turn back ON in a soft switching mode.

6. The apparatus of claim 2, wherein said controller controls said less than all of said plurality of switches in said the half bridge configuration to alternately turn ON and OFF in a soft switching mode.

7. The apparatus of claim 2, wherein said controller controls the operation of said less than all of said plurality of switches in said half bridge configuration to generate a swing voltage across said first inductance even if the arc between the electrodes is sustained.

8. The apparatus of claim 7, wherein said controller controls the operation of said less than all of said plurality of switches in said half bridge configuration to generate the swing voltage across said first inductance at least one time in a certain period.

9. The apparatus of claim 2, wherein said controller controls the operation of said less than all of said plurality of switches in said half bridge configuration to inhibit generation of the swing voltage when the arc extinguishes during the operation of the buck inverter function if a certain time has elapsed after the arc breaks down.

10. The apparatus of claim 1, wherein said buck inverter function with said second inductance-capacitance network delivers power to the discharge lamp changing a polarity at a frequency lower than a switching frequency of the buck inverter.

11. An apparatus for operating a gas discharge lamp, comprising: an electronic ballast, comprising:

a first inductance-capacitance network formed of a first inductance and a first capacitance;

a second inductance-capacitance network formed of a second inductance and a second capacitance;

a first half bridge configuration that utilizes said first inductance-capacitance network in an igniter function; and a second half bridge configuration that is utilized with said first half bridge configuration as a full bridge configuration, said full bridge configuration utilizing said second inductance-capacitance network in a buck inverter function; and a controller that controls said first half bridge configuration to ignite an arc between electrodes of a gas discharge lamp using said igniter function, said controller controlling said electronic ballast to change from said first half bridge configuration to said full bridge configuration after the arc is ignited so that said buck inverter function of said full bridge configuration sustains the arc between the electrodes of the gas discharge lamp, wherein said controller engages said transient operation to produce a swing voltage having a decreasing amplitude above and below a lamp voltage across said first inductance over a plurality of periods to effect re-ignition of the arc between the electrodes of the gas discharge lamp at least when the arc extinguishes.

12. The apparatus of claim 11, wherein said first half bridge configuration includes a first switch and a second switch, and said full bridge configuration includes said first switch, said second switch, a third switch and a fourth switch.

13. The apparatus of claim 12, wherein when said controller controls said electronic ballast to operate in said igniter function, said first switch and said second switch are alternately turned ON and OFF while said third switch and said fourth switch may be turned OFF.

14. The apparatus of claim 11, wherein the swing voltage is generated by said first half bridge configuration.

15. An apparatus for operating a gas discharge lamp, comprising: an electronic ballast, having:

a half bridge configuration formed by a first switch and a second switch;

a full bridge configuration formed by said first switch and said second switch, a third switch and a fourth switch;

a first network formed by a first inductance and a first capacitance; and a second network formed by a second inductance and a second capacitance; and a controller that controls:

said half bridge configuration to ignite an arc between electrodes of the gas discharge lamp in an igniter function that uses said first network;

to switch from said half bridge configuration to said full bridge configuration after the arc is ignited so that a buck inverter function using the second network sustains the arc between the electrodes of the gas discharge lamp; and to provide a transient operation function to the buck inverter function to produce a to produce a spike voltage having an amplitude that spikes above a lamp voltage between the electrodes for a period and that is followed afterwards by voltage with an amplitude below the lamp voltage for subsequent periods so that the lamp voltage decreases and so as to re-ignite the arc between the electrodes of the gas discharge lamp when the arc extinguishes.

16. The apparatus of claim 15, wherein said spike voltage is greater than an applied DC voltage applied to the full bridge configuration.

17. The apparatus of claim 15, wherein said transient operation function comprises a combination of said igniter function and said buck inverter function.

18. The apparatus of claim 15, wherein said first switch, said second switch, said third switch and said fourth switch each comprise a MOSFET transistor.

19. The apparatus of claim 15, wherein said transient operation function causes a current to flow into said first network to generate said spike voltage across said first inductance which then appears across the electrodes of the gas discharge lamp, a voltage level of said spike voltage being sufficient to re-ignite the arc between the electrodes of the gas discharge lamp.

20. The apparatus of claim 15, wherein said transient operation function is only applied during a predetermined time period after electrical power is applied to the gas discharge lamp and when a breakdown occurs.

* * * * *